US006318508B1

(12) United States Patent
Inoue

(10) Patent No.: US 6,318,508 B1
(45) Date of Patent: Nov. 20, 2001

(54) ELEVATING SYSTEM CONTROL METHOD AND APPARATUS SYNCHRONIZING PLURAL ELEVATING DEVICES

(75) Inventor: Shiro Inoue, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 09/596,570

(22) Filed: Jun. 16, 2000

(30) Foreign Application Priority Data

Jun. 25, 1999 (JP) ..... 11-180878

(51) Int. Cl.[7] ..... B66B 1/34

(52) U.S. Cl. ..... 187/394; 318/649

(58) Field of Search ..... 187/224, 234, 187/210, 391, 394, 284, 291, 292; 318/625, 85, 648, 74, 649, 41, 53, 69, 77

(56) References Cited

U.S. PATENT DOCUMENTS 3,831,713 * 8/1974 Clarke ..... 187/8.41
4,143,312 * 3/1979 Duckworth et al. ..... 318/649
5,447,317 * 9/1995 Gehlsen et al. ..... 187/200
5,597,988 * 1/1997 Skalski ..... 187/393
5,726,542 * 3/1998 Ebihara ..... 318/35
5,752,584 * 5/1998 Magoto et al. ..... 187/234
6,045,262 * 4/2000 Igeta et al. ..... 318/649

FOREIGN PATENT DOCUMENTS 10322626 11/1998 (JP) .

* cited by examiner

*Primary Examiner*—Jonathan Salata

(57) ABSTRACT

For each control period, a position of each elevator of a plurality of elevating devices is calculated, the farthest elevator from a designated movement destination position is determined as a reference elevator based on the position of each elevator thus calculated, position deviations of other elevators are calculated with respect to a position of the reference elevator, actuators of the elevators other than the reference elevator which have the position deviations outside a predetermined range are off controlled, and actuators of the elevator having the position deviation within the predetermined range and the reference elevator are on controlled.

9 Claims, 15 Drawing Sheets

ELEVATING SYSTEM CONTROL METHOD AND APPARATUS SYNCHRONIZING PLURAL ELEVATING DEVICES

BACKGROUND OF THE INVENTION

The present invention relates to a method and apparatus for synchronously controlling each elevating device of an elevating system having a combination of a plurality of elevating devices.

In the elevating system for elevating an object by synchronously controlling a combination of a plurality of elevating devices such as a jack, an electric motor cylinder, a hydraulic cylinder and the like, in the case in which the amount of elevation of each elevating device is not synchronized, an object to be elevated is tilted dangerously. For this reason, it is necessary to strictly synchronize the amount of elevation of each elevating device.

FIG. 1 is a typical view showing an example of the structure of a conventional elevating system formed by a combination of four elevating devices. In the conventional example, four elevating devices S are coupled through a joint axis R and a gear box G and are driven and elevated by means of an electric motor M to be one actuator. Consequently, mechanical synchronization is carried out. In such a structure in which the mechanical synchronization is carried out, however, it may be impossible to join the elevating devices S through the joint axis R and the gear box G depending on the surrounding circumstances.

It is also possible to apply a structure in which a hydraulic cylinder is used as an elevator and a hydraulic pump is used as an actuator, for example. In that case, it is necessary to connect the hydraulic pump and each hydraulic cylinder through a hydraulic hose. In some cases, however, it is impossible to connect the hydraulic pump and each hydraulic cylinder through the hydraulic hose depending on the surrounding circumstances in the same manner as in the above-mentioned example.

In order to solve the above-mentioned problem, there has been practically used a structure in which electric motors M1 to M4 are respectively fixed to four elevating devices S1 to S4 and are synchronously driven and brakes attached to the electric motors M1 to M4 are synchronously controlled to synchronize the amounts of elevations of the elevating devices S1 to S4 respectively as shown in the typical view of FIG. 2, for example. Each of the electric motors M1 to M4 shown in FIG. 2 should be an induction motor which can be synchronously controlled, for example.

Also in this case, it is possible to adopt a structure in which a hydraulic cylinder is used as an elevator and a hydraulic pump is used as an actuator, for example. In that case, it is necessary to attach the hydraulic pump to each hydraulic cylinder, thereby synchronously driving each hydraulic pump.

In the above-mentioned conventional structure in which an electric motor is attached to each elevating device and is synchronously driven, however, there has been a problem in that synchronization control precision is actually deteriorated. More specifically, on/off control is actually carried out such that a voltage to be applied to each electric motor is binary, for example, 0 V or a declared voltage. As synchronously driving means, a reference one of the elevating devices is determined in advance, the electric motors of other elevating devices are on/off controlled or reversely rotated depending on the operating condition of the reference elevating device, and furthermore, and a speed is regulated by utilizing a brake attached to the electric motor.

Consequently, the operations of other elevating devices are synchronized with that of the reference elevating device.

In the above-mentioned method, however, the control is carried out in such a manner that the elevating devices other than the predetermined reference elevating device are synchronized with the reference elevating device. Therefore, also in the case in which the elevating devices other than the reference elevating device are mutually synchronized (within an allowable range), very useless control is carried out so that the synchronization state among the mutual elevating devices is broken away by trying to synchronize all the elevating devices with the reference elevating device.

For this reason, the on/off and reverse rotation control of the electric motor and the use of the brake are carried out more frequently. Consequently, responsibility is deteriorated and synchronization precision is degraded. Since the brake to be used for the electric motor is generally an electromagnetic brake and is originally used for stopping, the responsibility is not very excellent, a lifetime is not very long and noises are made because of frequent use. Therefore, such a brake is not suitable for the use in speed control. Accordingly, there is a new problem in that it is necessary to separately adopt a powder brake or the like having excellent responsibility in addition to the brake for stopping which is originally attached to each electric motor, for example. Such a problem also arises in the case in which a hydraulic cylinder is used for an elevator and a hydraulic pump is used as an actuator, for example.

In order to determine the stop position of the elevating device, conventionally, the control has been carried out in such a manner that a coasting amount is measured in advance after a voltage to be applied to the electric motor is set to 0 V and the voltage to be applied to the electric motor is set to 0 V immediately before the original stop position based on the result of the measurement. However, such a coasting amount is varied according to the load of the elevating device, that is, the weight of an object to be elevated by means of the elevating device. Therefore, there is another problem in that stopping accuracy cannot be maintained. In order to solve such a problem, it is preferable that the coasting amount of the electric motor should be measured in advance according to the weight of the object to be elevated by means of the elevating device. However, this is very complicated practically.

Under such circumstances, the present inventor has proposed the invention filed in Japanese Patent Application No. Hei 10-322626 (1998). The invention filed in the Japanese Patent Application No. Hei 10-322626 (1998) relates to an elevating system control method for synchronously elevating a plurality of elevating devices each of which has an elevator, an actuator elevating the elevator, a driver driving the actuator and a detector detecting a position of the elevator and for moving them to designated movement destination positions by controlling each driver based on a result of detection of each detector for each control period, comprising a first step of calculating a position and a speed of each elevator according to the result of the detection of each detector, a second step of determining a target position where each elevator is to reach before a start point of a next control period based on the position and speed calculated at the first step, a third step of calculating an amount of movement in which each elevator is to be moved before a start point of the next control period based on the target position determined at the second step, and a fourth step of controlling each driver to drive each actuator corresponding to the amount of movement of each elevator determined at the third step, these steps being repeated for each control period.

In the elevating system control method filed in the Japanese Patent Application No. Hei 10-322626 (1998), the amount of movement in which each elevator is to be moved is calculated and the elevator is elevated synchronously for each control period. Therefore, control is carried out with high precision. However, in some cases in which security is maintained depending on the uses of the elevating system, the high precision is not required. In those cases, the invention filed in the Japanese Patent Application No. Hei 10-322626 (1998) is over specialized and a driver such as a servo driver or an inverter is required. Therefore, there is a problem in that the structure of an apparatus is comparatively expensive.

BRIEF SUMMARY OF THE INVENTION

It is an object of the present invention to provide an elevating system control method and apparatus capable of synchronously controlling a plurality of elevating devices with a simple processing and structure.

It is another object of the present invention to provide an elevating system control method and apparatus suitable for the case in which high precision is not comparatively necessary but economical properties are required instead.

It is a further object of the present invention to provide an elevating system control method and apparatus capable of performing synchronization control with high follow-up even if an elevator is dropped by inertia and synchronization cannot be carried out well.

The present invention provides a method comprising the steps of calculating a position of each elevator of a plurality of elevating devices, determining the farthest elevator from a designated movement destination position as a reference elevator based on the calculated position of each elevator, calculating position deviations of other elevators with respect to a position of the reference elevator, deciding whether the position deviation of each of the elevators other than the reference elevator is within a predetermined range (a first predetermined range), off controlling the actuator of the elevator which is decided to have the position deviation outside the predetermined range, and on controlling the actuators of the elevator decided to have the position deviation within the predetermined range and the reference elevator, the steps being repeated for each control period.

According to the present invention described above, other elevators are synchronously controlled based on the elevator which is provided in the farthest position from the designated movement destination position, that is, the elevator having the lowest follow-up for each control period. Accordingly, it is possible to carry out the synchronization control having high follow-up. Moreover, it is not necessary to take a coasting amount during stop into consideration. Therefore, the system can be installed and adjusted easily in a short time. Furthermore, in the case in which an electric motor is used as the actuator, it is not necessary to use an electromagnetic brake during synchronous driving. Therefore, noises are not made and the lifetime of the brake is not reduced. Moreover, a driver for driving the actuator is not required. Therefore, an inexpensive system can be implemented.

In addition to the above-mentioned control method, there are provided the steps of deciding whether the position deviations of the elevators other than the reference elevator are within a second predetermined range which is continuously set in an area closer to the designated movement destination position than the first predetermined range, and forcibly reversing an elevating operation of the elevator which is decided to have the position deviation within the second predetermined range or forcibly decreasing the speed thereof, the steps being repeated for each control period.

By such control, also in the case in which the elevator is dropped by inertia and the synchronization is not carried out well, forcible reverse rotation control or forcible deceleration is carried out so that the synchronization is maintained. Thus, synchronization control can be carried out with high follow-up.

The above and further objects and features of the invention will more fully be apparent from the following detailed description with accompanying drawings.

DETAILED DESCRIPTION OF THE INVENTION

Preferred embodiments of the present invention will be described below in detail with reference to the drawings.

Figure 1:
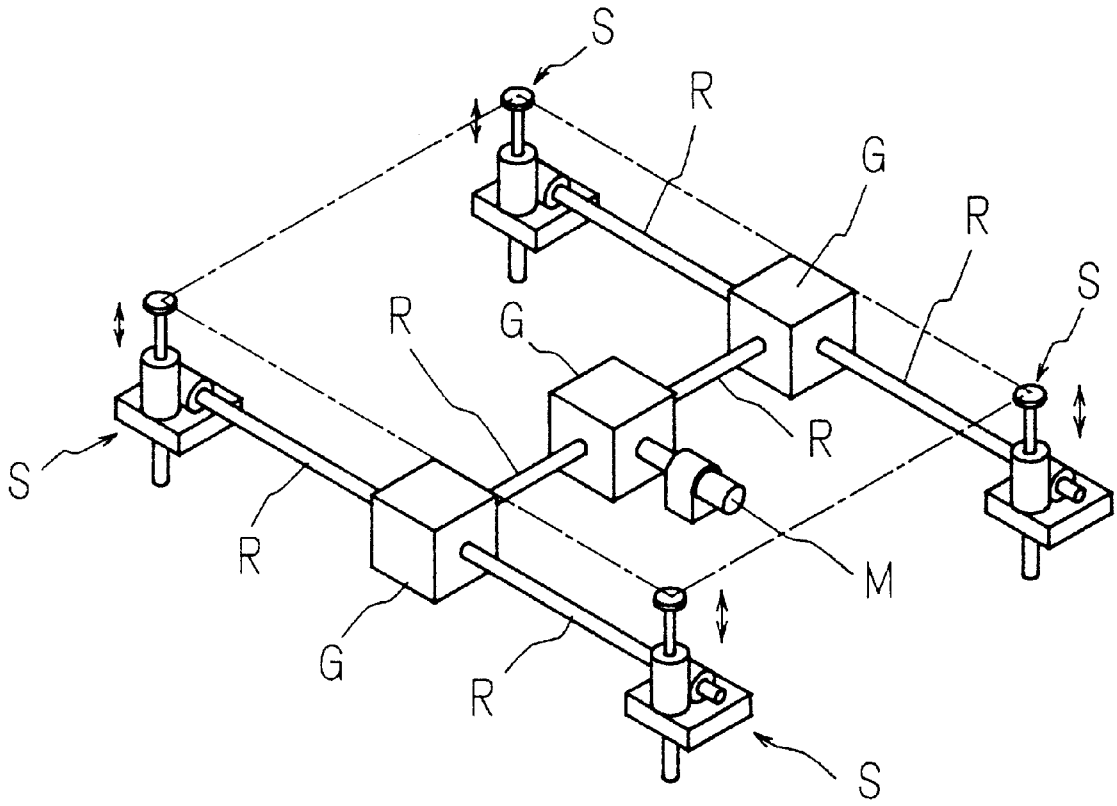
FIG. 1 PRIOR ART
FIG. 1 is a typical view showing an example of the structure of a conventional elevating system having a combination of four elevating devices.
Figure 2:
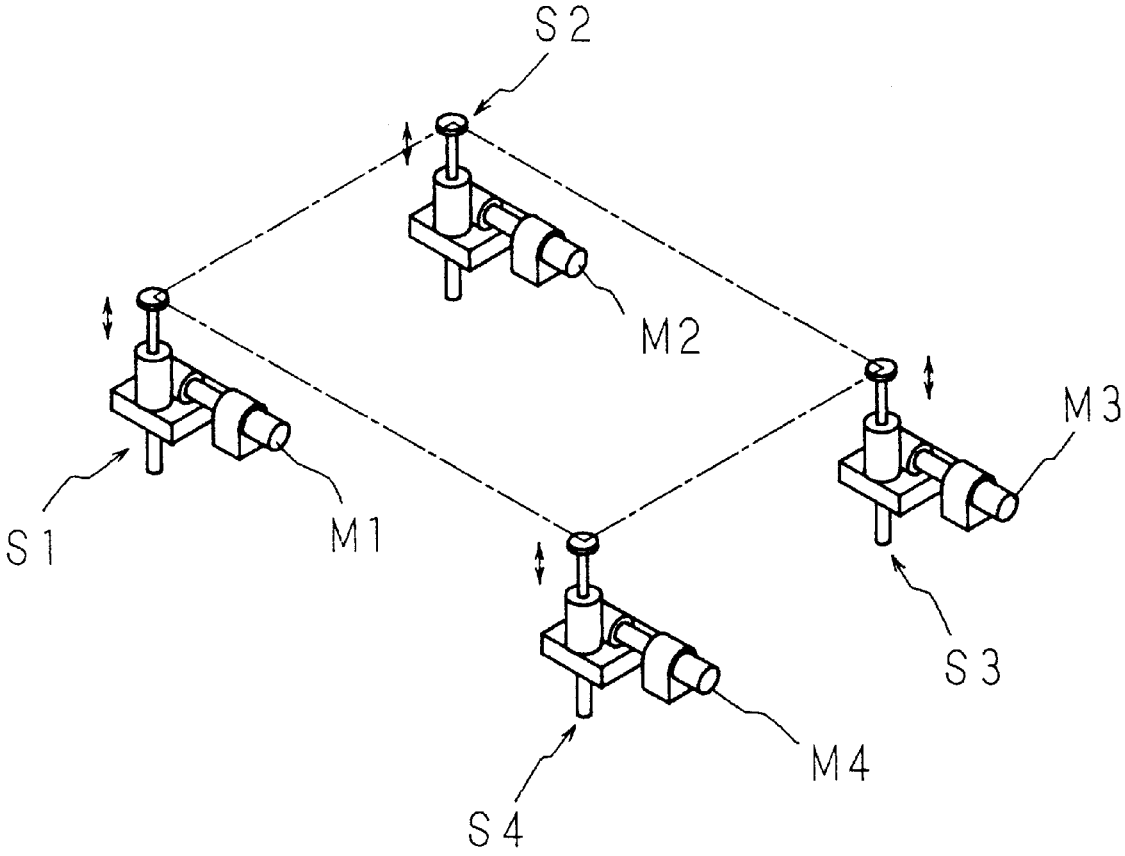
FIG. 2 PRIOR ART
FIG. 2 is a typical view showing another example of the structure of the conventional elevating system having a combination of four elevating devices.
Figure 3:
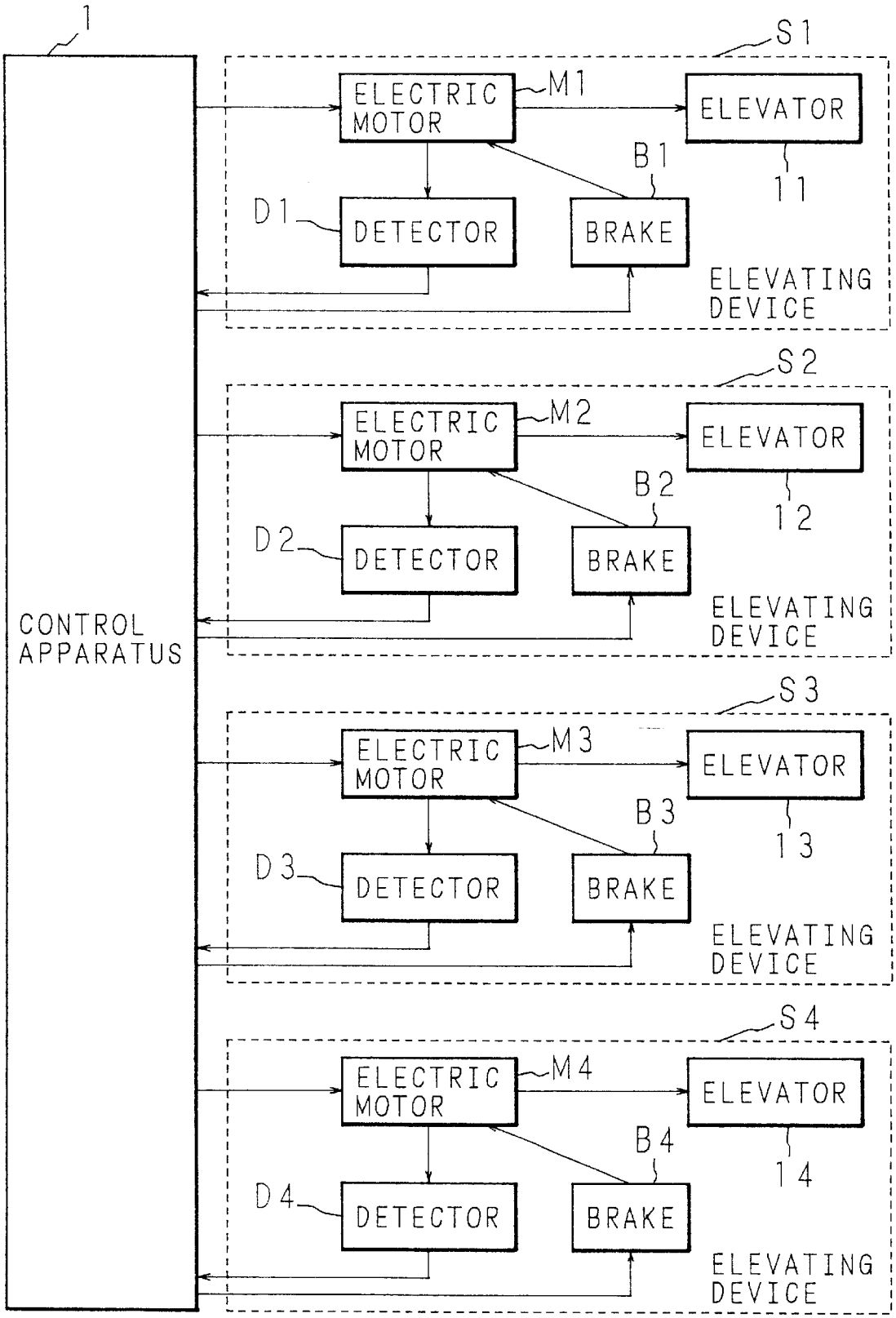
FIG. 3 is a block diagram showing an example of the structure of the elevating system which is to be controlled according to a first embodiment of an elevating system control apparatus of the present invention.

FIG. 3 is a block diagram showing an example of the structure of an elevating system which is to be controlled according to a first embodiment of an elevating system control apparatus of the present invention. While four elevating devices are controlled in this example, the same structure can be basically employed if the number of the elevating devices is two or more.

Four elevating devices S1, S2, S3 and S4 are constituted by electric motors M1, M2, M3 and M4 acting as actuators which are controlled to be driven by a control apparatus 1, elevating device bodies (which will be hereinafter referred to as elevators) 11, 12, 13 and 14 which are elevated by the electric motors M1, M2, M3 and M4, brakes B1, B2, B3 and B4 for braking the electric motors M1, M2, M3 and M4, and detectors D1, D2, D3 and D4 for detecting the elevating amounts of the elevators 11, 12, 13 and 14 by detecting the rotational numbers of the electric motors M1, M2, M3 and M4. The brakes B1, B2, B3 and B4 are controlled by the control apparatus 1, and the results of detection of the detectors D1, D2, D3 and D4 are input to the control apparatus 1.

In the first embodiment, encoders are used for the detectors D1, D2, D3 and D4, respectively.

Figure 4:
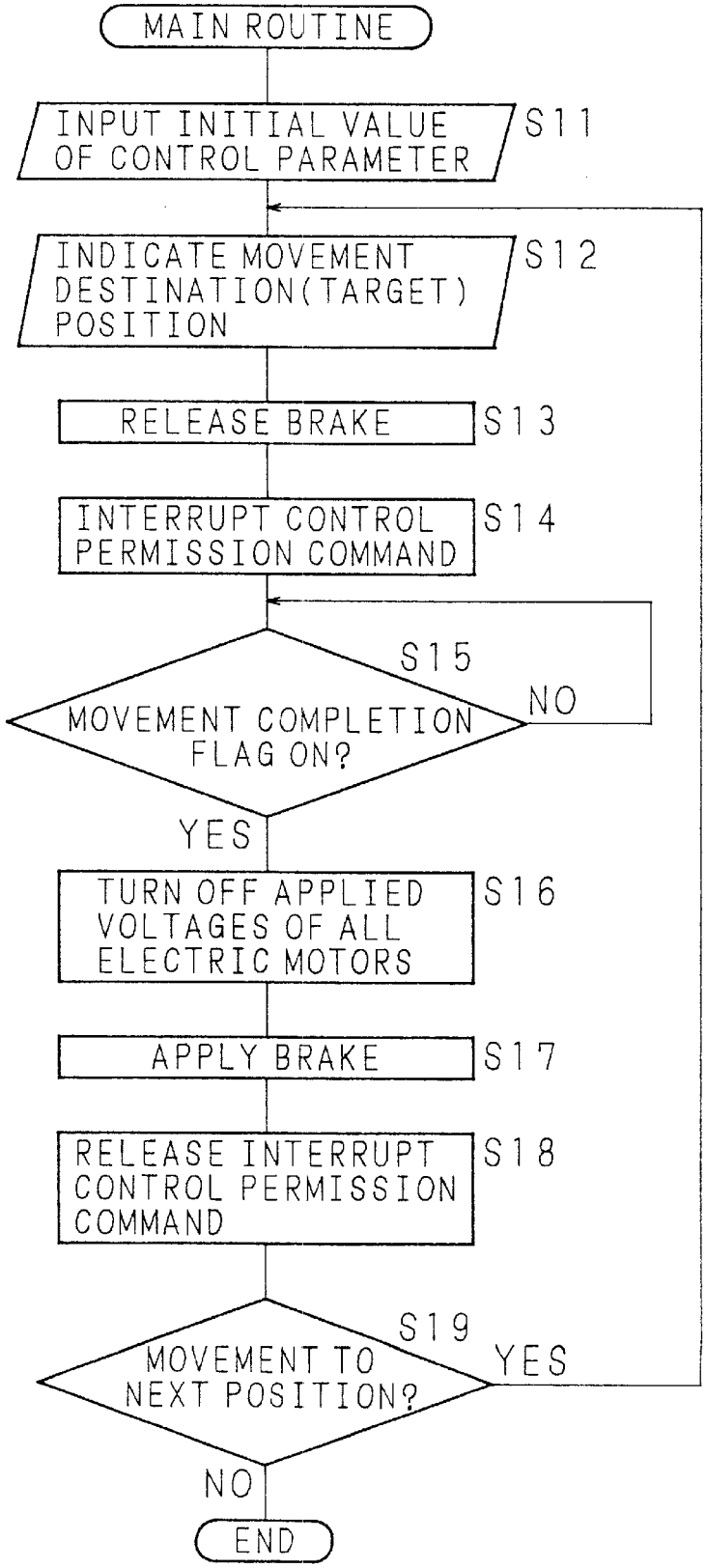
FIG. 4 is a flowchart showing the procedure for control of the elevating system control apparatus according to the first embodiment of the present invention.
Figure 5:
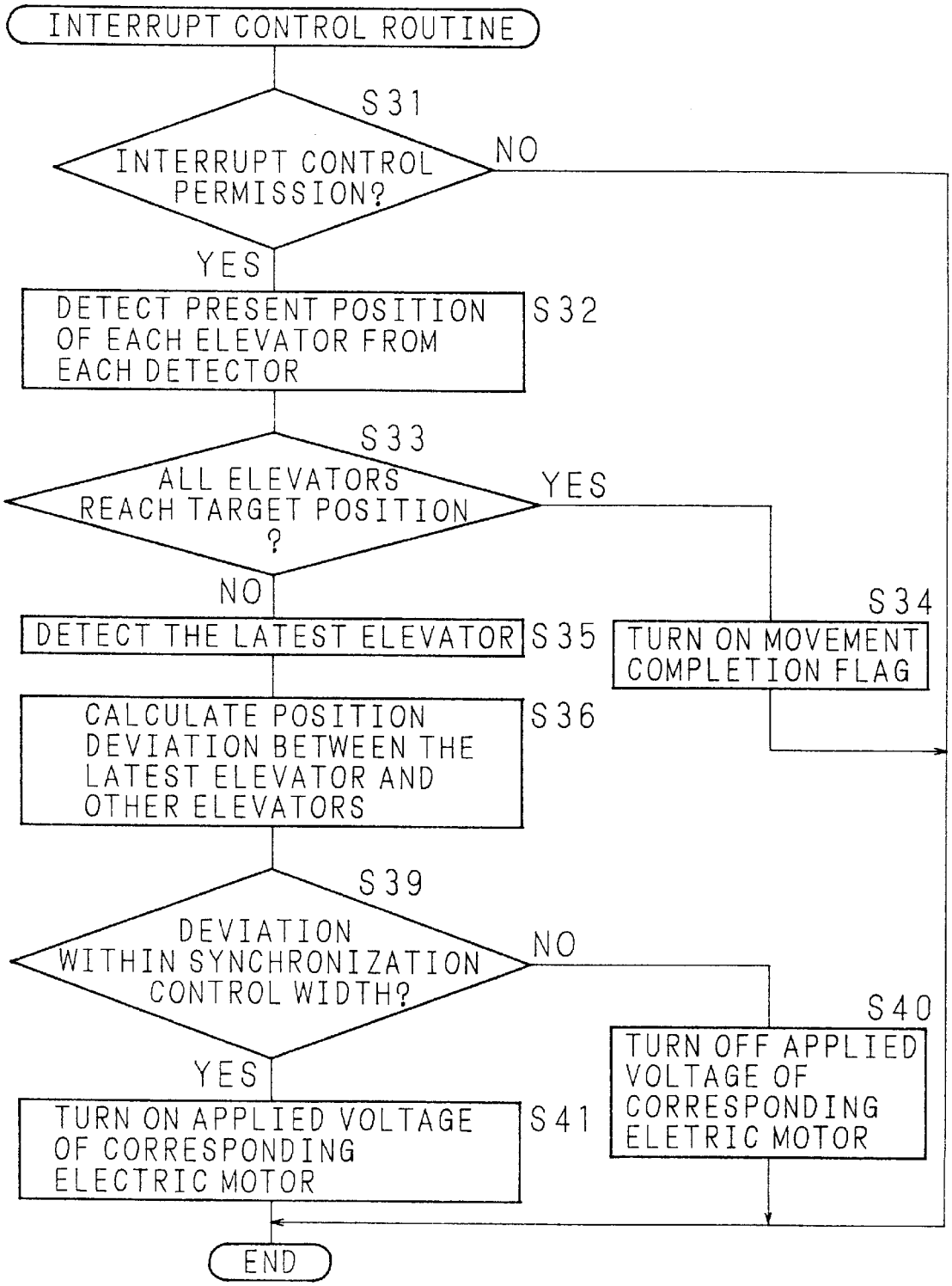
FIG. 5 is a flowchart showing the procedure for control of the elevating system control apparatus according to the first embodiment of the present invention.

FIG. 4 and FIG. 5 are flowcharts showing the procedure for control for synchronously controlling the elevating devices S1, S2, S3 and S4 by means of the control apparatus 1, which are constituted by a main routine shown in FIG. 4 and an interrupt routine shown in FIG. 5 that is interruptively executed for each control period during the execution of the main routine. An elevating system control method according to the present invention will be described below in accordance with these flowcharts.

First of all, the initial value of a control parameter is input to the control apparatus 1 in order to start the operation of the elevating system (Step S11). In this case, the parameter to be input to the control apparatus 1 includes an elevating amount of each of the elevators 11, 12, 13 and 14 per rotation of each of the electric motors M1, M2, M3 and M4, a resolution of each of the detectors D1, D2, D3 and D4, a declared rotational number of each of the electric motors M1, M2, M3 and M4, a synchronization control width preset as an allowable error range of a predetermined width for synchronously operating each of the elevators 11, 12, 13 and 14, a stop width preset as an allowable error range of a predetermined width for stopping each of the elevators 11, 12, 13 and 14 at a movement destination position, and the like.

Next, the control apparatus 1 indicates a movement destination (target) position where each of the elevators 11, 12, 13 and 14 is to finally reach (Step S12). The control apparatus 1 releases each of the brakes B1, B2, B3 and B4 which has fixed each of the electric motors M1, M2, M3 and M4 (Step S13), and issues an interrupt control permission command (Step S14). Consequently, an interrupt control routine which will be described below is executed for each control period so that the elevators 11, 12, 13 and 14 are moved.

After the interrupt control permission command is issued as described above, the control apparatus 1 is brought into a standby state until a movement completion flag is turned on in the interrupt control routine (Step S15). If the movement completion flag is turned on in the interrupt control routine, it is supposed that the elevators 11, 12, 13 and 14 have reached the movement destination target indicated at the Step S12, which will be described below in detail. Accordingly, when the movement completion flag is turned on ("YES" at Step S15), the control apparatus 1 turns off a voltage to be applied to each of the electric motors M1, M2, M3 and M4 (Step S16) and controls each of the brakes B1, B2, B3 and B4 to be brought into a braking state, so that each of the elevators 11, 12, 13 and 14 is fixed to a position at that time (Step S17).

Then, the control apparatus 1 releases the interrupt control permission command (Step S18). Consequently, the interrupt control routine is brought into a non-execution state so that each of the elevators 11, 12, 13 and 14 is maintained to be stopped at the indicated movement destination position. If each of the elevators 11, 12, 13 and 14 is to be moved to a different position again ("YES" at Step Sl9), the processing is returned to the Step S12 where a new movement destination position is indicated.

Next, description will be given to the interrupt control routine shown in FIG. 5. Although the interrupt control routine is executed for each control period of a predetermined time period, any processing is not executed and the routine ends if the interrupt control permission command is not issued at the Step S14 of the main routine ("NO" at Step S31).

If the interrupt control permission command is issued at the Step S14 of the main routine ("YES" at Step S31), the control apparatus 1 first detects the present positions of the elevators 11, 12, 13 and 14 based on the detection values of the detectors D1, D2, D3 and D4 (Step S32). As a result, if all the elevators 11, 12, 13 and 14 have reached the movement destination position indicated at the Step S12 of the main routine ("YES" at Step S33), the control apparatus 1 turns on the above-mentioned movement completion flag (Step S34) and the interrupt control routine ends. In this case, if each of the elevators 11, 12, 13 and 14 is actually positioned within the stop width (allowable error range) included in the initial value of the control parameter which is input in advance at the Step S11 of the main routine, it is decided that each of the elevators 11, 12, 13 and 14 reaches the movement destination position.

At the Step S33, if it is decided that at least one elevator 11 (or 12, 13, 14) has not reached the movement destination position indicated at the Step S12 of the main routine ("NO" at Step S33), any of the elevators 11, 12, 13 and 14 which is moved latest (farthest from the movement destination position) is detected (Step S35). The latest elevator is set to a reference elevator and position deviations between the latest elevator and three other elevators are calculated respectively (Step S36). Then, it is decided whether each of the position deviations is within the synchronization control width (allowable error range) included in the initial value of the control parameter which is input in advance at the Step S11 of the main routine (Step S39). Referring to the elevator which is not positioned within the synchronization control width with respect to the reference elevator ("NO" at Step S39), a voltage to be applied to the electric motor of the corresponding elevator is turned off (Step S40). Referring to the elevator which is positioned within the synchronization control width with respect to the reference elevator ("YES" at Step S39), a voltage to be applied to each of the corresponding elevator and the reference elevator is turned on (Step S41).

By the processing of the Step S40, the voltage to be applied to the electric motor of the elevator which is out of the synchronization control width, that is, which approaches the movement destination position beyond the synchronization control width is turned off based on the latest one of the four elevators 11, 12, 13 and 14, that is, the elevator which is the farthest from the movement destination position. Therefore, the elevator is decelerated and controlled such that a position deviation is reduced with respect to the reference elevator. By the processing of the Step S41, moreover, the voltage to be applied to the electric motor of the elevator which is positioned within the synchronization control width, that is, which is synchronously controlled with the synchronization control width (including the reference elevator) is turned on based on the latest one of the four elevators 11, 12, 13 and 14, that is, the elevator which is the farthest from the movement destination position. Therefore, the elevators are controlled to be maintained in the synchronization control state.

The above-mentioned control is repeated for each control period. Consequently, the control is carried out such that the speeds of three other elevators are coincident with the speed of the farthest (latest) elevator from the movement destination position for each control period and the positions of three other elevators are set within the synchronization control width, in other words, follow-up is performed.

Next, a second embodiment of the present invention will be described. While the electric motors M1, M2, M3 and M4 of the elevators 11, 12, 13 and 14 are on/off controlled in the first embodiment, the most suitable synchronous operation cannot be carried out by only the on/off control depending on the actual operating situations in some cases. In those cases, the electric motor is reversely rotated or the brake is used in order to take measures. Specific description will be given to the second embodiment in which the most suitable synchronous operation cannot be carried out by only the on/off control according to the first embodiment.

Figure 6:
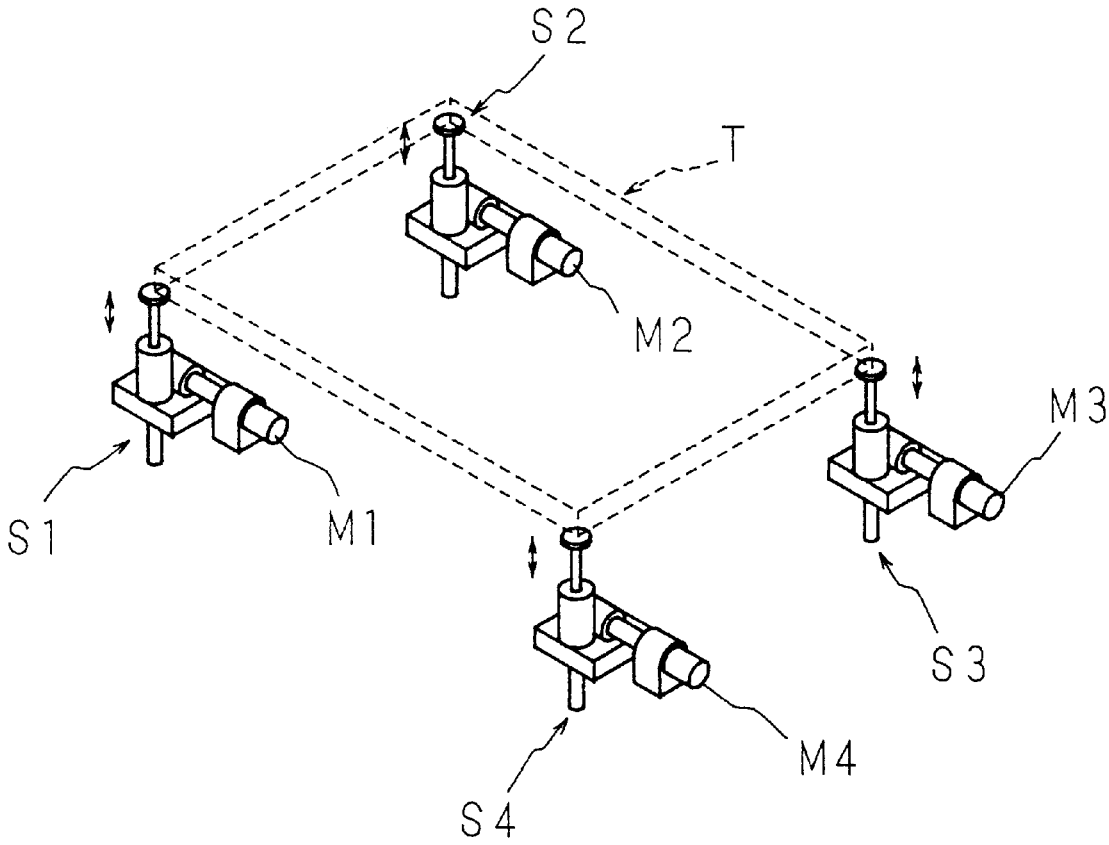
FIG. 6 is a typical view illustrating an example in which the most suitable synchronous operation cannot be carried out by only on/off control of the elevating system control apparatus according to the first embodiment of the present invention.

As a first example, if the above-mentioned first embodiment is applied to a downward operation to be performed when all the elevators 11, 12, 13 and 14 are fixed and connected through an object having a high rigidity, for example, a table T as shown in the typical view of FIG. 6, for example, the following problem arises.

In the case in which an electric motor of an elevator is turned off at the Step S40 of the interrupt control routine shown in FIG. 5, the elevator is decelerated to enter the synchronization control width with respect to the reference elevator. Therefore, the electric motor of the elevator is turned on for a next control period. As shown in the typical view of FIG. 6, however, in the case in which all the elevators 11, 12, 13 and 14 are coupled through the object having a high rigidity such as the table T, the elevator is pushed by other elevators and is moved downward out of the synchronization control width when the electric motor is brought into an OFF state, that is, a free state. In such a case, accordingly, even if the control according to the first embodiment is to be carried out, the elevator is continuously moved downward with the electric motor in the OFF state and the control cannot be performed effectively.

As a second example, for the downward operation to be performed when a load which is almost equal to an allowable load is applied to each of the elevators 11, 12, 13 and 14 with such a structure that each of the elevators 11, 12, 13 and 14 is not coupled through the object having a high rigidity and a decelerator or the like is not attached to the electric motor, if a voltage to be applied to the electric motor is off, the electric motor is brought into the free state. Consequently, the elevator is accelerated to a speed which is equal to or higher than a declared speed and is moved downward. Also in this case, accordingly, even if the control according to the first embodiment is to be carried out, the elevator is continuously moved downward with the electric motor set in the OFF state in the same manner as described above. Consequently, the synchronization control cannot be carried out effectively.

In the above-mentioned examples, there is a possibility that troubles might be made in the control according to the first embodiment. As the second embodiment, therefore, the control apparatus 1 is caused to execute the interrupt control routine shown in the flowchart of FIG. 7 or FIG. 8.

In the second embodiment, the same processing as that in the main routine according to the first embodiment shown in FIG. 4 is carried out in a main routine according to the second embodiment. In the second embodiment, a non-damping permission width set to be a predetermined width outside of the above-mentioned synchronization control width is input for the input of the initial value of the control parameter to the control apparatus 1 at the Step S11. The non-damping permission width is set in order to invert the electric motor and forcibly reverse the elevating operation of the elevator or to apply braking and forcibly decelerate the elevator when the position deviations of other elevators depart from the non-damping permission width with respect to the reference elevator in the interrupt control routine.

Figure 7:
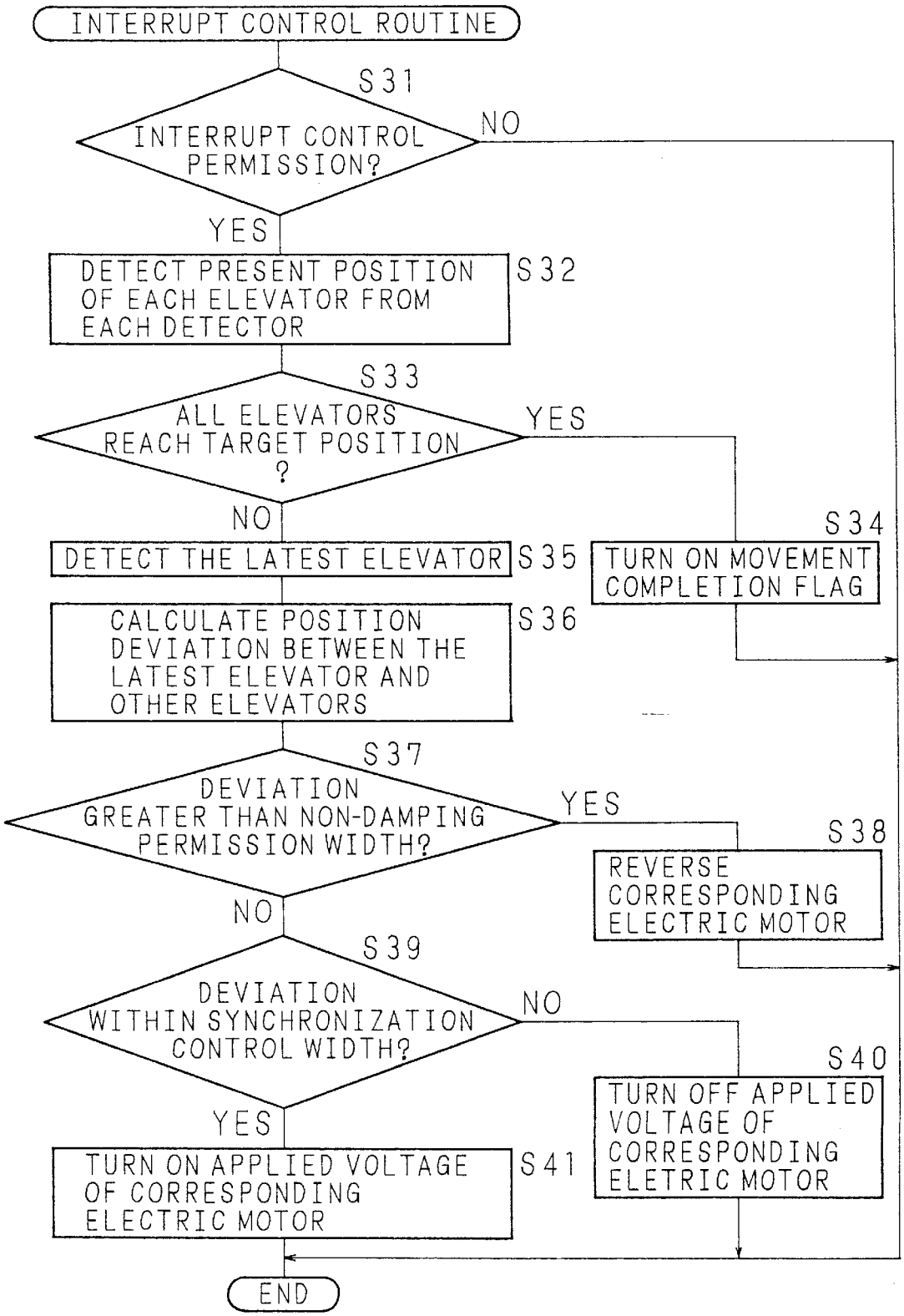
FIG. 7 is a flowchart showing the procedure for control of the elevating system control apparatus according to a second embodiment of the present invention.
Figure 8:
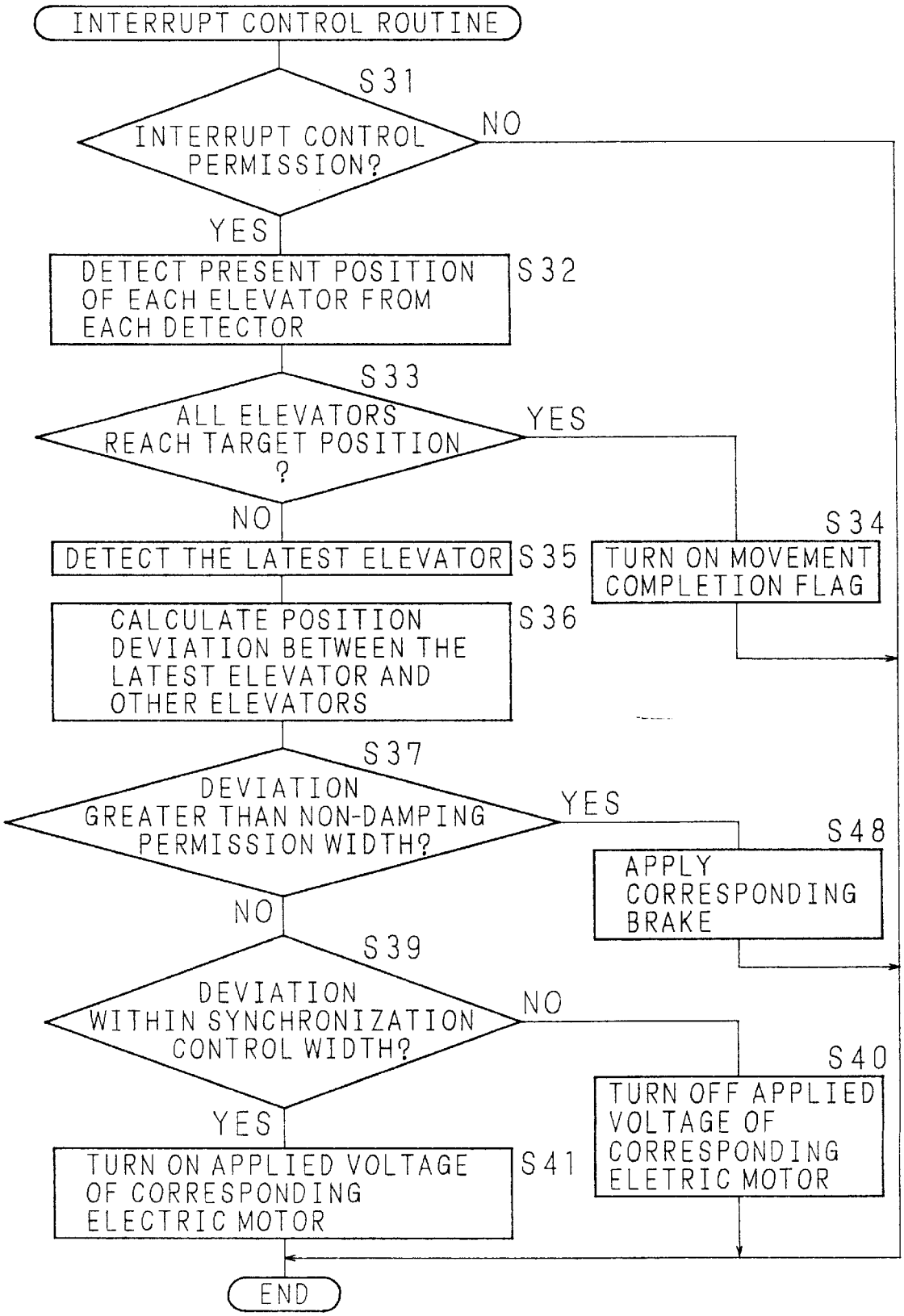
FIG. 8 is a flowchart showing another procedure for control of the elevating system control apparatus according to the second embodiment of the present invention.

In the flowchart shown in FIG. 7 or FIG. 8, processings from Step S31 to Step S36 and Step S39 to Step S41 are the same as those of the interrupt control routine according to the first embodiment, and Steps S37 and S38 or Steps S37 and S48 are added between the Steps S36 and S39 differently from the interrupt control routine according to the first embodiment. More specifically, the following control is carried out.

In the example shown in FIG. 7, a reference elevator is detected at the Step S35 in the same manner as in the first embodiment and the position deviations of other elevators with respect to the reference elevator are calculated at the Step S36. At the Step S37, if the position deviation of each of the elevators other than the reference elevator with respect to the reference elevator is greater than the non-damping permission width, that is, the other elevators are positioned apart from the reference elevator beyond the non-damping permission width ("YES" at Step S37), the control apparatus 1 reversely controls the electric motor of the corresponding elevator, thereby forcibly reversing the elevating operation of the elevator (Step S38). Consequently, the position deviation of the corresponding elevator with respect to the reference elevator is reduced and enters the synchronization control width for a next control period. In that case, therefore, the processing is executed from the Step S37 to the Step S39.

In the example shown in FIG. 8, a reference elevator is detected at the Step S35 in the same manner as in the first embodiment and the position deviations of other elevators with respect to the reference elevator are calculated at the Step S36. At the Step S37, if the position deviation of each of the elevators other than the reference elevator with respect to the reference elevator is greater than the non-damping permission width, that is, the other elevators are positioned apart from the reference elevator beyond the non-damping permission width ("YES" at Step S37), the control apparatus 1 applies braking to the corresponding elevator and forcibly reduces the speed of the elevator (Step S48). Consequently, the position deviation of the corresponding elevator with respect to the reference elevator is reduced and enters the synchronization control width for a next control period. In that case, therefore, the processing is executed from the Step S37 to the Step S39.

On the other hand, if the position deviations of the elevators other than the reference elevator with respect to the reference elevator are not greater than the non-damping permission width ("NO" at Step S37) and are within the synchronization control width ("YES" at Step S39), the control apparatus 1 turns on the electric motor of the corresponding elevator to perform acceleration (Step S41). If the position deviations are not within the synchronization control width ("NO" at Step S39), the control apparatus 1 turns off the electric motor of the corresponding elevator to perform deceleration (Step S40). Thus, the control is carried out such that the position deviations with respect to the reference elevator are reduced respectively.

Referring to the above-mentioned examples in which the most suitable synchronous operation cannot be carried out by only the on/off control according to the first embodiment, it is possible to return the synchronization state by the control according to the second embodiment.

Figure 9:
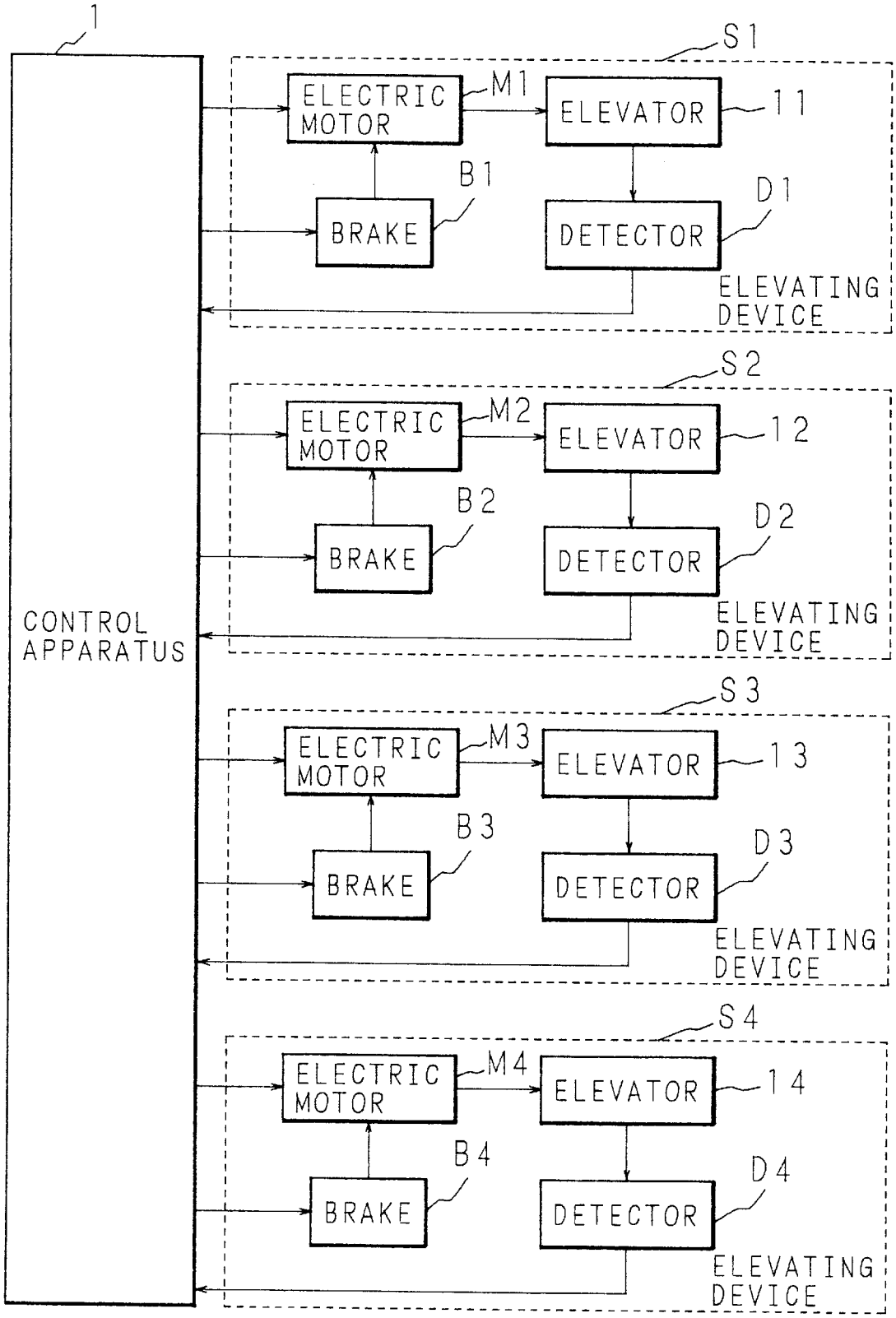
FIG. 9 is a block diagram showing an example of the structure of an elevating system control apparatus according to a third embodiment of the present invention.

FIG. 9 is a block diagram showing an example of the structure of an elevating system control apparatus according to a third embodiment of the present invention. In the third embodiment, the detectors D1, D2, D3 and D4 do not detect the rotational numbers of the electric motors M1, M2, M3 and M4 but directly detect the positions (elevating amounts) of the elevators 11, 12, 13 and 14 in the above-mentioned first and second embodiments.

With such a structure according to the third embodiment, the control can be carried out with higher precision than in the first and second embodiments. In some cases, however, it is necessary to employ such a structure that the detectors D1, D2, D3 and D4 detect the rotational numbers of the electric motors M1, M2, M3 and M4 to be replaced with the movement amounts of the elevators 11, 12, 13 and 14 as in the first and second embodiments depending on an environment in which an elevating system is to be provided.

It is apparent that the procedure for control to be carried out by a control apparatus 1 according to the third embodiment .can employ both the first and second embodiments. Also in each of the above-mentioned embodiments, it is possible to employ such a structure that a hydraulic cylinder is used as an elevator and a hydraulic pump is used as an actuator, for example.

Figure 10:
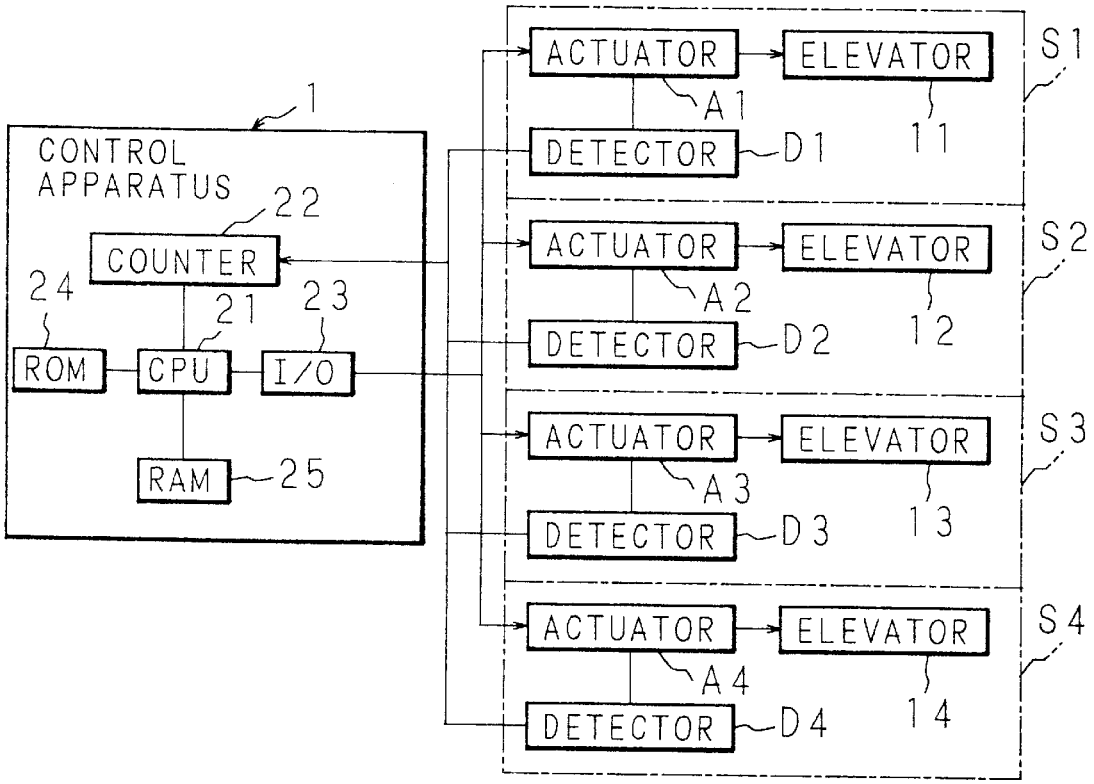
FIG. 10 is a block diagram showing an example of the structure of the elevating system control apparatus according to the present invention.

The control apparatus 1 is generally constituted as shown in the block diagram of FIG. 10. More specifically, the control apparatus 1 comprises a counter 22 for inputting and counting the detected outputs of the detectors D1, D2, D3 and D4 of the elevating devices S1, S2, S3 and S4, a CPU (microcomputer) 21 for inputting the count value of the counter 22 as the present position of each of the elevators 11, 12, 13 and 14 and executing the main routine and the interrupt control routine shown in the above-mentioned flowchart, an interface (I/O) 23 for on/off controlling actuators A1, A2, A3 and A4 such as the electric motors of the elevating devices S1, S2, S3 and S4 with a digital output in accordance with the result obtained by the execution of the main routine and the interrupt control routine by the CPU 21, a ROM 24 for storing a program for the main routine and the interrupt control routine, and a RAM 25 to be used as a working memory for the CPU 21. While brakes B1, B2, B3 and B4 of the elevating devices S1, S2, S3 and S4 are not shown in FIG. 10, it is apparent that they are controlled by the I/O 23 of the control apparatus 1.

Figure 11:
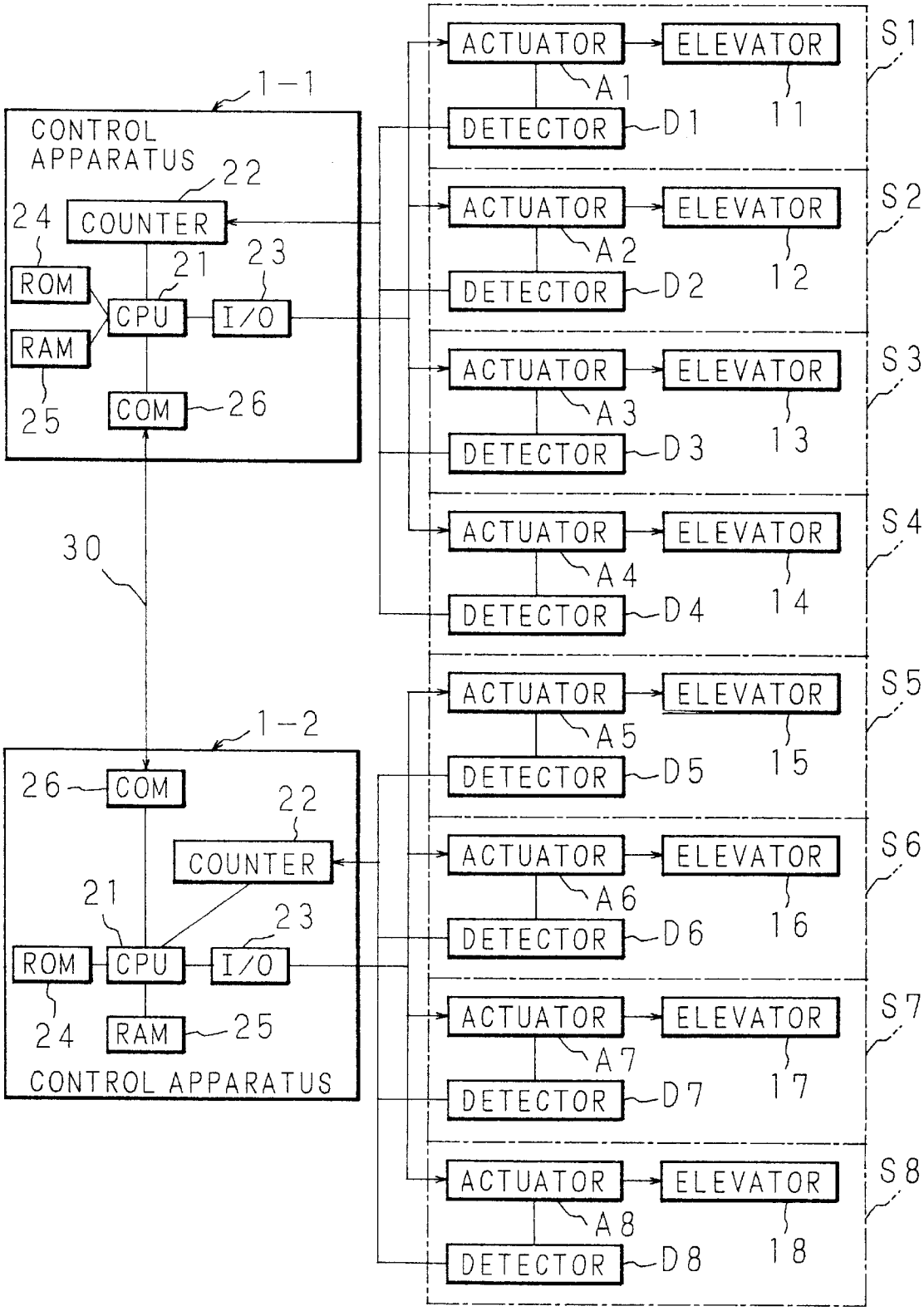
FIG. 11 is a block diagram showing another example of the structure of the elevating system control apparatus according to the present invention.

While the example in which four elevating devices S1, S2, S3 and S4 are connected to one control apparatus 1 has been described in the above-mentioned embodiments as shown in FIG. 10, it is necessary to provide a plurality of control apparatuses if more elevating devices are used. In that case, a structure shown in the block diagram of FIG. 11 is employed. More specifically, two control apparatuses 1-1 and 1-2 are prepared, four elevating devices S1, S2, S3 and S4 are connected to the control apparatus 1-1, and four elevating devices S5, S6, S7 and S8 having the same structures as those of the elevating devices S1, S2, S3 and S4 are connected to the control apparatus 1-2, respectively, and a communicating device (COM) 26 is provided in the control apparatuses 1-1 and 1-2. The COMs 26 of the control apparatuses 1-1 and 1-2 are connected to each other through a communicating line 30 having a communication standard such as RS232C, thereby performing communication. Consequently, the CPUs 21 of the control apparatuses 1-1 and 1-2 are interlockingly operated so that eight elevating devices S1, S2, S3, S4, S5, S6, S7 and S8 are synchronously controlled.

However, also in the case in which the structure shown in FIG. 11 is employed, at most eight elevating devices can be controlled. Furthermore, in the case in which six or seven elevating devices are to be controlled, for example, wastes are caused and it is necessary to change a control program for each of the CPUs 21.

Under such circumstances, it is desirable that the control apparatus 1 should have the following structure. As a first example, it is possible to employ a structure shown in the block diagram of FIG. 12.

Figure 12:
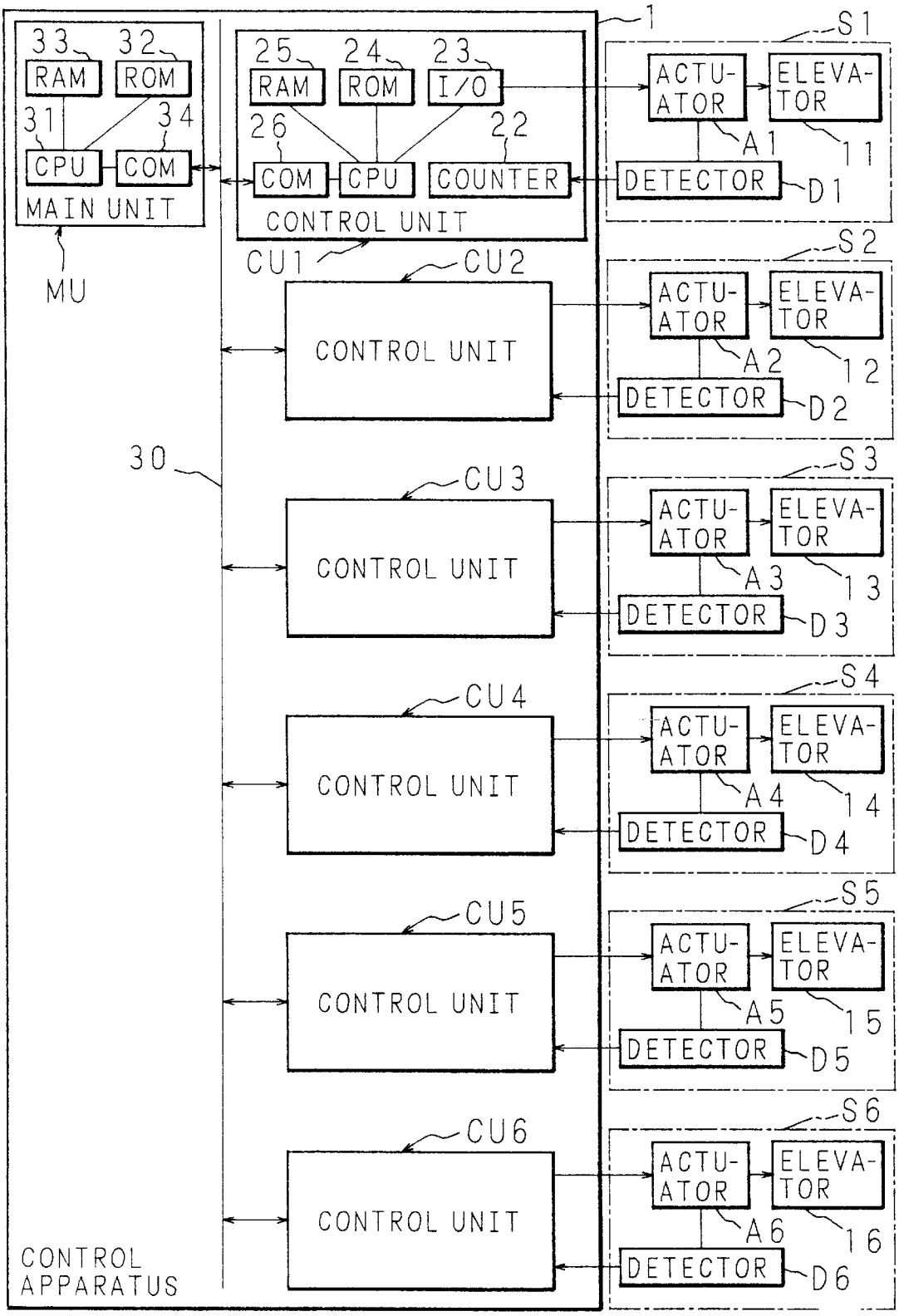
FIG. 12 is a block diagram showing yet another example of the structure of the elevating system control apparatus according to the present invention.

In FIG. 12, six elevating devices S1, S2, S3, S4, S5 and S6 are connected to one control apparatus 1. The control apparatus 1 is constituted by one main unit MU, the same number of control units CU1, CU2, CU3, CU4, CU5 and CU6 as that of the elevating devices, each of them being connected to one elevating device.

The control units CU1, CU2, CU3, CU4, CU5 and CU6 have the same structures, each of them including a counter 22 for inputting and counting the detected output of the detector D1(or D2, D3, D4, D5, D6) of the elevating device S1 (or S2, S3, S4, S5, S6), a CPU (microcomputer) 21 for inputting the count value of the counter 22 as the present position of the elevator 11 (or 12, 13, 14, 15, 16) and executing the main routine and the interrupt control routine shown in the above-mentioned flowchart, an interface (I/O) 23 for on/off controlling an actuator A1 (or A2, A3, A4, A5, A6) such as the electric motor of the elevating device S1 (or S2, S3, S4, S5, S6) with a digital output in accordance with the result obtained by the execution of the main routine and the interrupt control routine by the CPU 21, a ROM 24 for-storing a program for the main routine and the interrupt control routine, a RAM 25 to be used as a working memory for the CPU 21, and a communicating device (COM) 26.

While brakes B1, B2, B3, B4, B5 and B6 of the elevating devices S1, S2, S3, S4, S5 and S6 are not shown in FIG. 12, it is apparent that they are controlled by the I/Os 23 of the corresponding control units CU1, CU2, CU3, CU4, CU5 and CU6, respectively.

The COM 26 of each of the control units CUI, CU2, CU3, CU4, CU5 and CU6 is connected to the main unit MU through a communicating line 30 having a communication standard such as RS485.

The main unit MU includes a CPU 31, a ROM 32 for storing a control program for the main unit MU, a RAM 33 to be a working memory for the CPU 31, and a communicating device (COM) 34 for performing communication with the COM 26 of each of the control units CU1, CU2, CU3, CU4, CU5 and CU6. One-to-many communication is carried out by using the control units CU1, CU2, CU3, CU4, CU5 and CU6 as substations and the COM 34 of the main unit MU as a main station. Consequently, the main unit MU collects position information of each of the elevators 11, 12, 13, 14, 15 and 16 from each of the control units CU1, CU2, CU3, CU4, CU5 and CU6, and gives information for the execution of synchronization control to each of the control units CU1, CU2, CU3, CU4, CU5 and CU6. Each of the control units CU1, CU2, CU3, CU4, CU5 and CU6 controls each of the actuators A1, A2, A3, A4, A5 and A6 in accordance with the information given from the main unit MU, and moves each of the elevators 11, 12, 13, 14, 15 and 16.

In the example shown in FIG. 12, the actuators A1, A2, A3, A4, A5 and A6 are induction motors, and a control output from the I/O 23 of each of the control units CU1, CU2, CU3, CU4, CU5 and CU6 is on/off (binary) control for setting an input voltage to the induction motor to 0 V or a declared voltage. In the example shown in FIG. 12, moreover, six elevating devices are synchronously controlled. In the case in which the number of the elevating devices is smaller or greater than six, the number of the control units may be decreased or increased corresponding to the number of the elevating devices.

Figure 13:
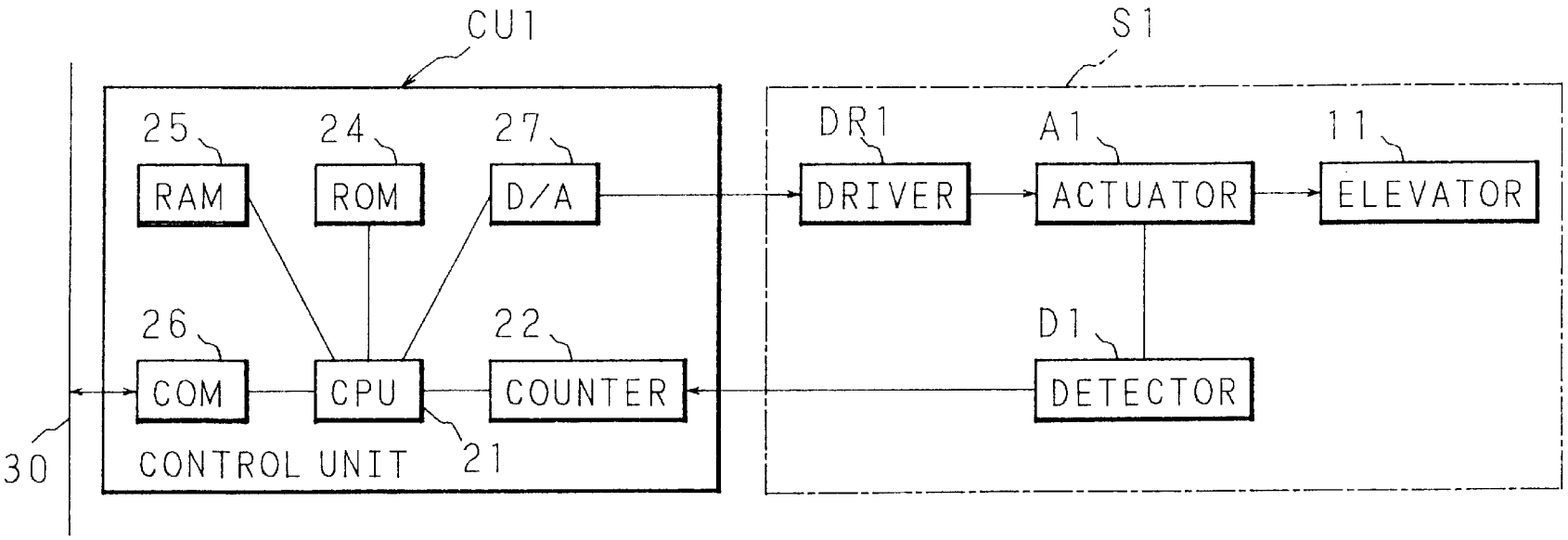
FIG. 13 is a block diagram showing a further example of the structure of the elevating system control apparatus according to the present invention.

FIG. 13 is a block diagram showing an example of the structure of each control unit in the case in which an actuator is driven by a driver as disclosed in the invention of Japanese Patent Application No. Hei 10-322626 (1998) which has been previously filed by the present inventor, for example. More specifically, there is shown an example of the structures of an elevating device S1 and a control unit CU1 for controlling the elevating device S1. In the same manner as in FIG. 12, other elevating devices and control units are provided.

In this example, the actuator A1 of the elevating device S1 is a servo motor or an induction motor and a servo driver or an inverter is used as a driver DR1 for driving the actuator A1. Therefore, the control unit CU1 is provided with a D/A converter 27 for outputting an analog voltage to the driver DR1.

In the case in which the driver DR1 is a servo motor to be driven by a pulse input, pulse output means may be provided in place of the D/A converter 27.

Figure 14:
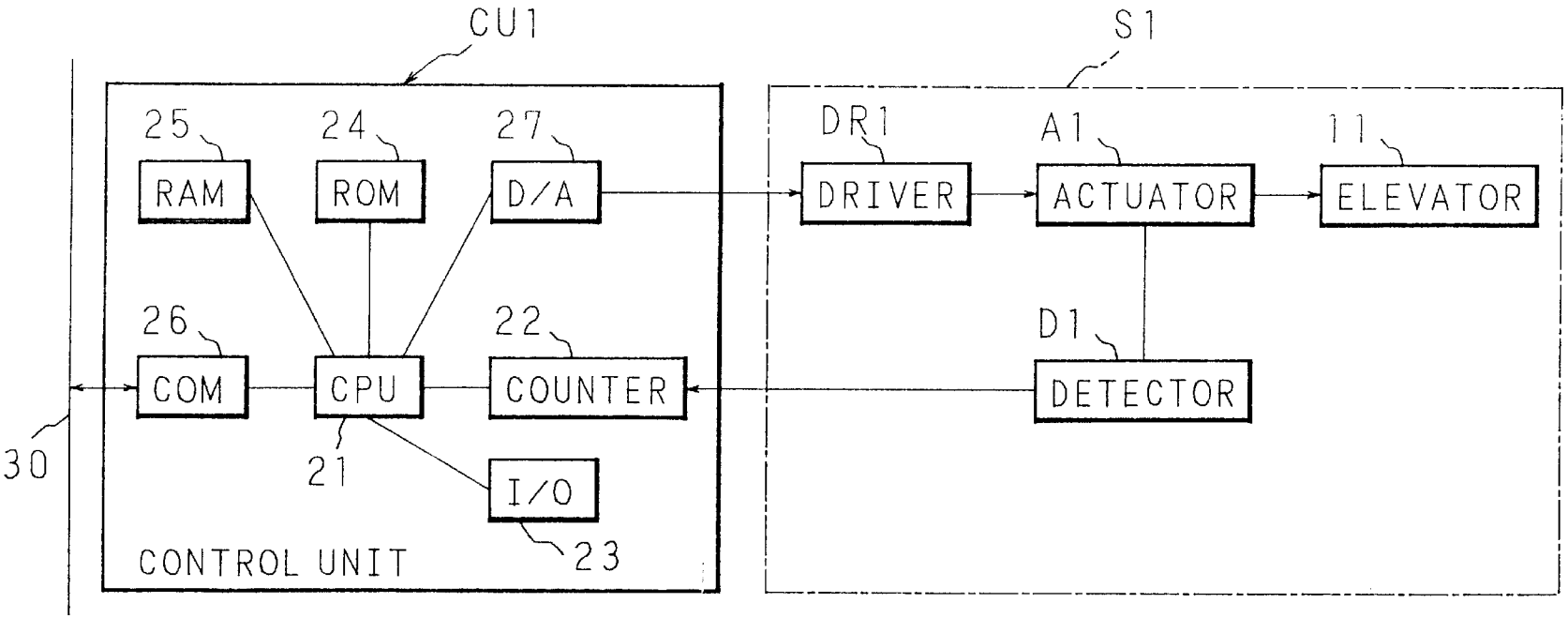
FIG. 14 is a block diagram showing a further example of the structure of the elevating system control apparatus according to the present invention.
Figure 15:
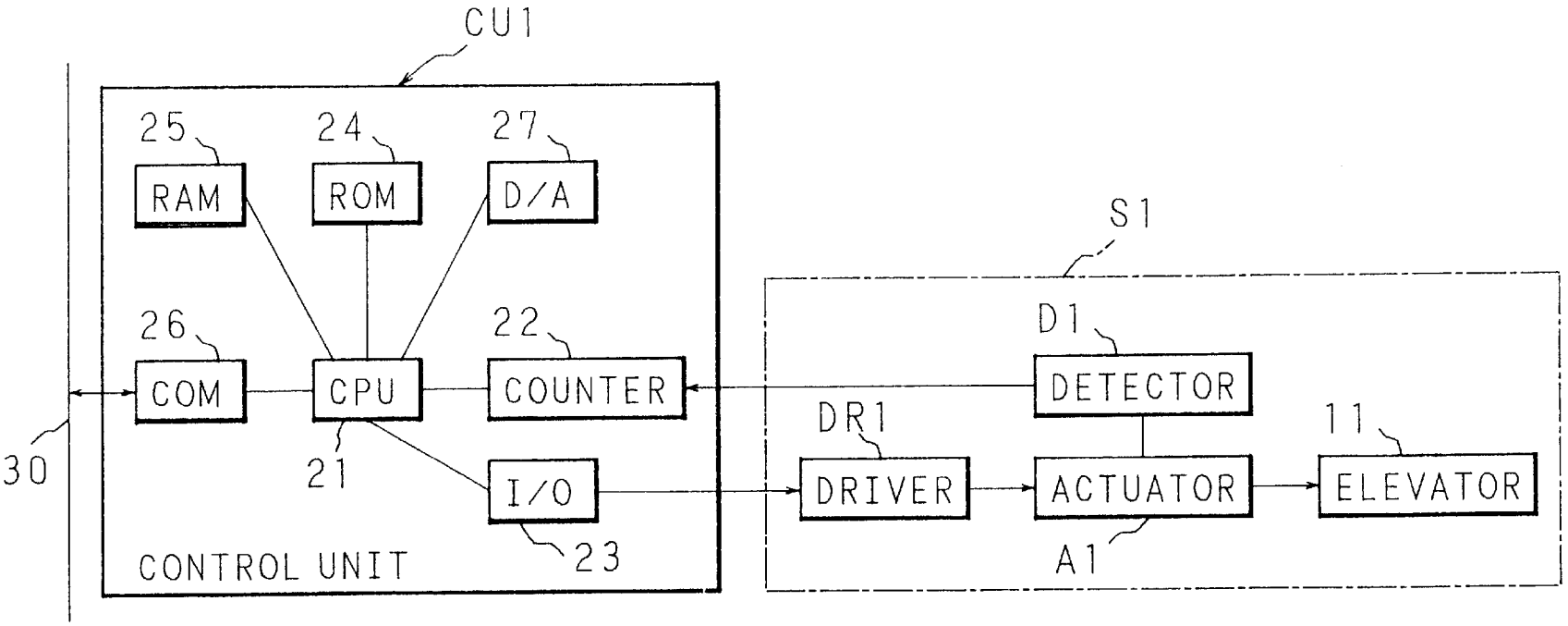
FIG. 15 is a block diagram showing a further example of the structure of the elevating system control apparatus according to the present invention.

FIG. 14 and FIG. 15 are block diagrams showing a structure in which the control unit CUl is provided with both the I/O 23 shown in FIG. 12 and the D/A converter 27 shown in FIG. 13. Thus, in the case in which the control unit CU1 is provided with both the I/O 23 and the D/A converter 27, it is possible to control actuators (electric motors) of almost all types.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An elevating system control method for synchronously elevating a plurality of elevating devices each of which has an elevator, an actuator elevating the elevator and a detector detecting a position of the elevator and for moving the elevating devices to a designated movement destination position by on/off controlling the actuator based on a result of detection of the detector for each control period, comprising the steps of:

calculating a position of each elevator in accordance with the result of detection of the detector;

determining the farthest elevator from the designated movement destination position as a reference elevator based on the calculated position of each elevator;

calculating position deviations of other elevators with respect to a position of the reference elevator;

deciding whether the position deviation of each of the elevators other than the reference elevator is within a first predetermined range;

off controlling the actuator of the elevator which is decided to have the position deviation outside the first predetermined range; and on controlling the actuators of the elevator decided to have the position deviation within the first predetermined range and the reference elevator, the steps being repeated for each control period.

2. The elevating system control method according to claim 1, further comprising the steps of:

deciding whether the position deviation of each of other elevators calculated with respect to the position of the reference elevator is within a second predetermined range which is continuously set in an area closer to the designated movement destination position than the first predetermined range; and forcibly reversing an elevating operation of the elevator which is decided to have the position deviation within the second predetermined range, the steps being repeated for each control period.

3. The elevating system control method according to claim 1, further comprising the steps of:

deciding whether the position deviation of each of other elevators calculated with respect to the position of the reference elevator is within a second predetermined range which is continuously set in an area closer to the designated movement destination position than the first predetermined range; and forcibly decelerating the elevator which is decided to have the position deviation within the second predetermined range, the steps being repeated for each control period.

4. An elevating system control apparatus for synchronously elevating a plurality of elevating devices each of which has an elevator, an actuator elevating the elevator and a detector detecting a position of the elevator and for moving the elevating devices to a designated movement destination position by on/off controlling the actuator based on a result of detection of the detector for each control period, comprising:

a position calculator calculating a position of each elevator in accordance with the result of detection of the detector for each control period;

a determiner determining the farthest elevator from the designated movement destination position as a reference elevator based on the position of each elevator calculated by the position calculator for each control period;

a deviation calculator calculating position deviations of other elevators with respect to a position of the reference elevator determined by the determiner for each control period;

a first deciding unit deciding whether the position deviation of each of the elevators other than the reference elevator which is calculated by the deviation calculator is within a preset first predetermined range for each control period; and a controller off controlling the actuator of the elevator which is decided to have the position deviation outside the first predetermined range by the first deciding unit and on controlling the actuators of the elevator decided to have the position deviation within the first predetermined range and the reference elevator for each control period.

5. The elevating system control apparatus according to claim 4, further comprising:

a second deciding unit deciding whether the position deviation calculated by the deviation calculator is within a second predetermined range which is continuously set in an area closer to the designated movement destination position than the first predetermined range for each control period; and a driver forcibly performing reverse control of an elevating operation of the elevator which is decided to have the position deviation within the second predetermined range by the second deciding unit for each control period.

6. The elevating system control apparatus according to claim 4, further comprising:

a second deciding unit deciding whether the position deviation calculated by the deviation calculator is within a second predetermined range which is continuously set in an area closer to the designated movement destination position than the first predetermined range for each control period; and a decelerator forcibly decelerating the elevator which is decided to have the position deviation within the second predetermined range by the second deciding unit for each control period.

7. An elevating system, comprising:

a plurality of elevating devices each of which has an elevator, an actuator elevating the elevator and a detector detecting a position of the elevator; and a control device synchronously elevating the elevating devices and moving the elevating devices to a designated movement destination position by on/off controlling the actuator based on a result of detection of the detector for each control period, wherein the control device includes:

a position calculator calculating a position of each elevator in accordance with the result of detection of the detector for each control period;

a determiner determining the farthest elevator from the designated movement destination position as a reference elevator based on the position of each elevator calculated by the position calculator for each control period;

a deviation calculator calculating position deviations of other elevators with respect to a position of the reference elevator determined by the determiner for each control period;

a first deciding unit deciding whether the position deviation of each of the elevators other than the reference elevator which is calculated by the deviation calculator is within a preset first predetermined range for each control period; and a controller off controlling the actuator of the elevator which is decided to have the position deviation outside the first predetermined range by the first deciding unit and on controlling the actuators of the elevator decided to have the position deviation within the first predetermined range and the reference elevator for each control period.

8. The elevating system according to claim 7, wherein the control device includes:

a second deciding unit deciding whether the position deviation calculated by the deviation calculator is within a second predetermined range which is continuously set in an area closer to the designated movement destination position than the first predetermined range for each control period; and a driver forcibly performing reverse control of an elevating operation of the elevator which is decided to have the position deviation within the second predetermined range by the second deciding unit for each control period.

9. The elevating system according to claim 7, wherein the control device includes:

a second deciding unit deciding whether the position deviation calculated by the deviation calculator is within a second predetermined range which is continuously set in an area closer to the designated movement destination position than the first predetermined range for each control period; and a decelerator forcibly decelerating the elevator which is decided to have the position deviation within the second predetermined range by the second deciding unit for each control period.

* * * * *